United States Patent [19]

Simons

[11] 4,216,518

[45] Aug. 5, 1980

[54] CAPACITIVELY COUPLED STATIC ELIMINATOR WITH HIGH VOLTAGE SHIELD

[75] Inventor: Dolph Simons, Philadelphia, Pa.

[73] Assignee: The Simco Company, Inc., Lansdale, Pa.

[21] Appl. No.: 930,028

[22] Filed: Aug. 1, 1978

[51] Int. Cl.[2] ..... H01T 19/04

[52] U.S. Cl. ..... 361/213; 361/229; 361/230

[58] Field of Search ..... 361/212, 213, 214, 220, 361/229, 230

[56] References Cited

FOREIGN PATENT DOCUMENTS 1556678 2/1969 France ..... 361/230

*Primary Examiner*—Harry E. Moose, Jr.

*Attorney, Agent, or Firm*—Stanley Bilker

[57] ABSTRACT

In a shockless type static eliminator having pointed discharge electrodes capacitively coupled to the high voltage side of an A.C. power source and a grounded conductive member or housing adjacently spaced from the discharge points, the improvement comprising the interposing of a high voltage shield about the capacitor plates from which the discharge points project in order to minimize the capacitance between such capacitor plates and ground. The reduced plate-to-ground capacitance, $C_g$, enables a greater portion of the supply voltage, $V_s$, to be applied to the discharge points without increasing the discharge electrode-to-high voltage capacitance, $C_p$, thereby permitting the use of smaller and less expensive power supply and static bar constructions.

15 Claims, 14 Drawing Figures

FIG. 1
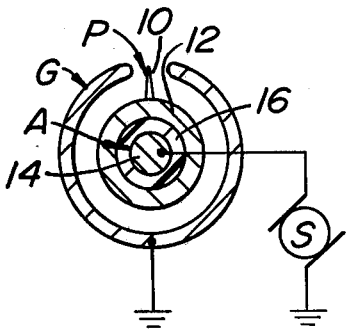
FIG. 2
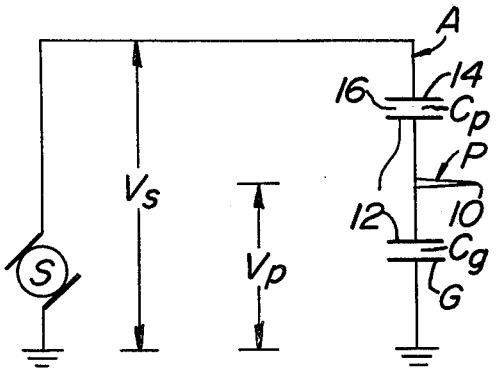
FIG. 3
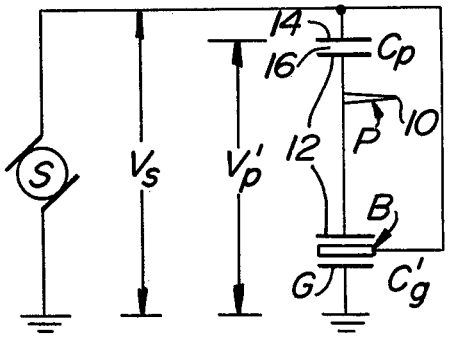
FIG. 4
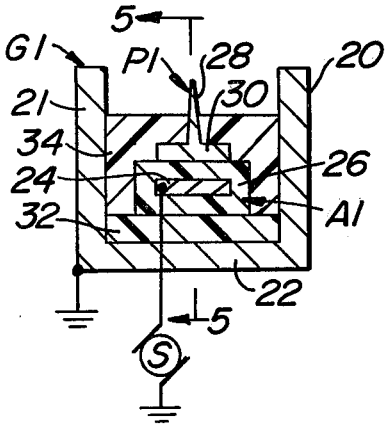
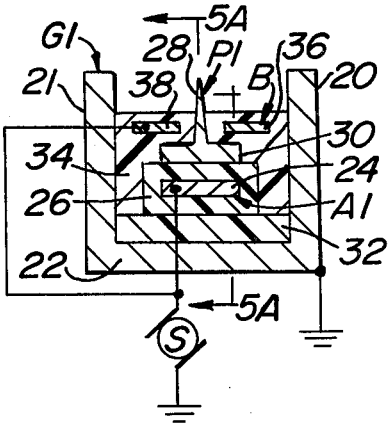
FIG. 4A

CAPACITIVELY COUPLED STATIC ELIMINATOR WITH HIGH VOLTAGE SHIELD

FIELD OF THE INVENTION

This invention relates to static eliminators for impinging ions of both polarities against the surfaces of articles in order to neutralize static charges which have accumulated thereon. More particularly, this invention relates to "shockless" type static eliminators or neutralizers in which the discharge electrodes or ionizing points are capacitively coupled to an A.C. high voltage power source for the purpose of limiting the current discharging capability of the discharge electrodes in the event that the points themselves are accidentally touched by operating personnel or fortuitously shunted to ground by certain objects. The present invention is especially concerned with the reduction of the capacitance between the discharge electrodes and ground in regard to such shockless static eliminators whereby a greater portion of the A.C. supply voltage may be applied to the discharge points, thus enabling the size and voltage requirements of the static bars and their A.C. power supply sources to be diminished.

BACKGROUND OF THE INVENTION

Static eliminators are devices for producing both positive and negative ions in order to neutralize articles which have been charged to a particular polarity, usually as a result of electrostatic, electrical, frictional or mechanically created forces. When an A.C. voltage of fairly high magnitude is applied across the discharge points and the grounded casing or shield of such static bars, ions of both polarities are emitted.

In a shockless static bar, the A.C. power source is coupled to the discharge points by way of a capacitance in order to limit the maximum shorting current that can occur should an object, such as the fingers of operating personnel, accidentally shunt across the points and ground. Capacitively coupled bars are well known in the art and generally embody a construction in which a plurality of needle-like points are electrically connected to respective spaced apart conductive sleeves or plates which are arranged in close proximity to an elongated cable having an inner conductive core surrounded by a dielectric layer. A grounded housing or conductive member is adjacently spaced from the needle points and generally supports the discharge assembly while a high voltage A.C. source, in the range of about 2,500 to 15,000 volts, is connected across the inner conductive core and ground. The high voltage applied to the inner core produces an ionized field about the pointed ends of the discharge needles which has the effect, when directed toward a charged article, sheet or web, to neutralize the static charges accumulated thereon. Examples of various types of capacitively coupled static eliminators are shown and described in U.S. Pat. No. 2,163,294, No. 2,333,213, No. 3,120,626, No. 3,443,155, No. 3,585,448, No. 3,652,897, No. 3,875,461 and No. 4,092,543.

In any capacitively coupled static eliminator, the voltage applied to the points by a high voltage A.C. power source is a function of the relationship between the discharge electrode-to- high voltage conductor capacitance and the electrode-to-adjacent ground capacitance. That is, assuming that the point-to-ground resistance is extremely high, as would be the case, the voltage actually applied to the points with respect to the input voltage of the A.C. power source is, as may be seen from FIG. 2 of the drawings, determined by the following:

$$Vp = \frac{Cp}{Cp + Cg} Vs$$

where $V_p$=the voltage applied to each of the points, $C_p$=capacitance between the discharge electrodes and the high voltage cable conductor, $C_g$=capacitance between discharge electrodes and adjacent ground, and $V_s$=power supply input voltage.

As is apparent from the foregoing, a greater portion of the supply voltage, $V_s$, can be applied to the points either by increasing $C_p$ or by decreasing $C_g$. In view of the fact that an increase in $C_p$ necessarily augments the current discharge capability or shock, a result counter to the particular purpose of the capacitively coupled design, the present invention contemplates reduction in the value of $C_g$. By minimizing $C_g$, it is also readily apparent that the voltage on the points ($V_p$) will approach the supply voltage $V_s$ whereby a much smaller supply voltage will produce the same degree of ionization at the points. Along with the reduction in power supply voltage requirements, there is also a lesser amount of insulation necessary in both the static bar and the power pack, thus enabling further diminution of their physical sizes as well as the components thereof, all with attendant economies in cost. Reduction in power supply voltage additionally reduces the likelihood of corona effects at locations other than the ionizing points themselves whereby objectionable ozone pollution of the environment by such static eliminators is minimized.

In the present invention, the diminution of the value of $C_g$ (discharge electrode-to-ground capacitance) is accomplished by providing a high voltage shield between the capacitor plates of such electrodes and the next adjacent ground while the points of such electrodes are fully exposed in juxtaposed spaced relation to ground in order to provide efficient ionization without the latter contributing appreciably to the ground capacitance $C_g$ because of the minute surface area of said points. The high voltage shield of this invention is effected by interposing a conductive member between ground and the capacitor plates which are capacitively coupled to the high voltage bus and connecting the high voltage power source or the high voltage bus to the shielding conductive member.

It is therefore an object of this invention to provide a shockless type static eliminator in which the power supply voltage requirements are reduced without sacrificing ionization efficiency.

Another object of this invention is to provide a capacitively coupled static eliminator in which the physical size of both the static bar and the power pack as well as all of the components thereof are diminished.

Still another object of this invention is to provide a capacitively coupled static eliminator in which the ground leg capacitance is reduced without increasing the capacitance of the high voltage leg, thereby retaining high ionization efficiency at limited current discharge capabilities.

Other objects of this invention are to provide an improved device of the character described which is easily and economically produced, sturdy in construction, and highly efficient and effective in operation.

DESCRIPTION OF THE DRAWINGS

With the above and related objects in view, this invention consists of the details of construction and combination of parts as will be more fully understood from the following detailed description when read in conjunction with the accompanying drawings, in which:

FIG. 1 is a cross sectional view of a prior art co-axial cable type shockless static eliminator with which the present invention is concerned.

FIG. 2 is a schematic diagram of the equivalent circuit for the prior art shockless type static eliminator.

FIG. 3 is a schematic diagram of the equivalent circuit for the capacitively coupled shockless static eliminator of the present invention.

FIG. 4 is a cross sectional view of one embodiment of a shockless static eliminator in accordance with the present invention.

FIG. 4A is a cross sectional view of an improvement of the embodiment shown in FIG. 4.

DETAILED DESCRIPTION

Figure 5:
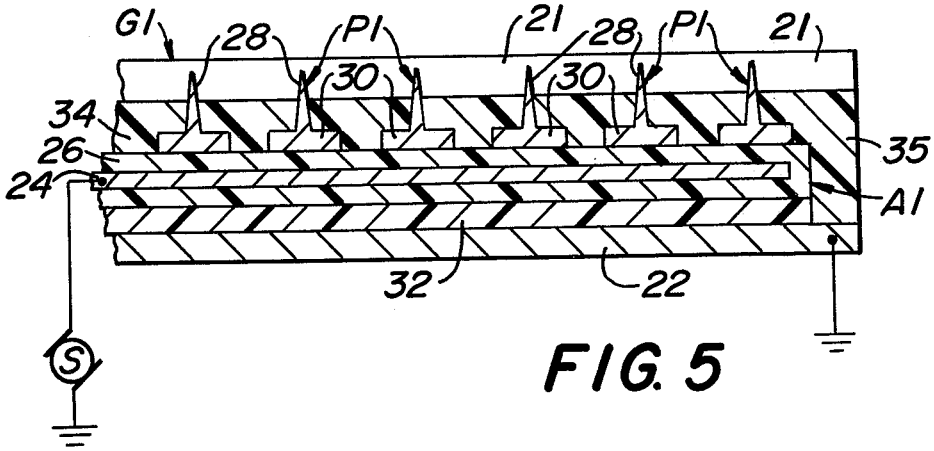
FIG. 5 is a sectional view taken along lines 5—5 of FIG. 4.

Referring now in greater detail to the drawings in which similar reference characters refer to similar parts, there is shown a shockless static eliminator in which discharge electrodes P are capacitively coupled to the high voltage side of an A.C. power source S through an insulated cable or bus, generally designated as A. The other side of the A.C. power source S is normally at ground level and is connected via ground to a conductive member G which is adjacently spaced from the points of the discharge electrodes P whereby an electric field is created in the air gap therebetween for emission of ions of both polarities to be impinged upon the surface of the article to be neutralized.

A capacitively coupled co-axial type static eliminator of the prior art is illustrated in FIG. 1, and in FIG. 2 is demonstrated diagrammatically the equivalent circuit of such a conventional shockless static eliminator. The discharge electrodes P comprise pointed needles or spikes 10 which project from condenser plate portions 12, the latter being adjacently spaced from and capacitively coupled to the central conductor 14 of cable A through the insulative layer or sheath 16 to define a capacitance $C_p$ therebetween. The points 10 of the discharge needles or electrodes P are adjacently spaced from the juxtaposed ground G, which either may be a housing for the electrodes or may constitute the machinery itself in operation upon the articles which require neutralization. The high voltage power supply S is also well known in the prior art and is adapted to develop and furnish an output of about 2,500 to 15,000 volts A.C..

In the prior art capacitively coupled neutralizers, up to about one half of the supply voltage $V_s$ was utilized to counteract the effect of the capacitance $C_g$ brought about by the coupling between the plates 12 to which the points are connected and ground. That is, the condenser or capacitor plates 12 not only formed capacitors vis-a-vis the high voltage cable A but also produced capacitances in respect to the ground member G "seen" by the said plates 12. As is evident from FIG. 2, the voltage $V_p$ applied to the points was a function of the relationship between the point-to-high voltage capacitance $C_p$ and the point-to-ground capacitance $C_g$, as set forth hereinbefore, namely $$Vp = \frac{Cp}{Cp + Cg} Vs$$

In the present invention, a high voltage shield B (i.e. a conductive member directly connected to the A.C. power supply S) is interposed between the condenser plates 12 and ground G so that the effective capacitance $C_g$ is reduced, hence maximizing the voltage drop across the latter. See FIG. 3.

By diminishing the plate-to-ground capacitance $C_g$ to a much smaller value, $C_g'$, a greater voltage $V_p'$ relative to the supply voltage $V_s$ is produced across the discharge electrodes P. Accordingly, the supply voltage $V_s$ may be appropriately reduced without altering the ionization potential at the points 12, thus allowing the use of smaller A.C. power supplies S for the same ion emission from the discharge electrodes P.

Referring now to FIGS. 4 and 5, there is shown one embodiment of the improved shockless static eliminator wherein a plurality of discharge electrodes P1 are capacitively coupled to a flat cable A1 to which the high voltage side of power supply S is connected. The ground side of the power supply S is connected to an elongated U-shaped conductive housing G1 defined by a pair of longitudinally extending sides 20 and 21 upstanding from a medial portion 22. The cable A1 includes, for example, a flat conductive bus 24 having an insulated sheath 26 of such material as polyvinyl chloride extruded thereabout. The discharge electrodes P1 are each in the form of a pointed needle 28 which extends perpendicularly to a flat rectangular plate 30. The plates 30 may be formed in any suitable manner, such as by way of deposition of a conductive material upon the surface of an insulative strip, to define a plurality of longitudinally spaced islands to which the pointed needles 28 are conveniently affixed, such as by stapling. Thus, the conductive discharge electrodes P1 are capacitively coupled by way of the plates 30 to the central conductor bus 24 of the cable A1. A dielectric core molded of a suitable insulative material, such as methyl methacrylate resin, includes an elongated base member 32 and an inverted yoke 34 which retains the discharge electrodes P1 within the housing G1 in fixed disposition with respect to the cable A1, and in the event the plates 30 are made of sheet metal sections, the core maintains the sheet metal plates in longitudinally spaced disposition with respect to each other. Suitable end caps 35 support the dielectric core 32–34 along the cable A1 and the discharge electrodes P1 in fixed disposition within the housing G1. As is apparent, the plates 30 are each capacitively coupled to the central conductor 34 of cable A1 through the insulation 26 thereof. However, at the same time, the conductor 24 which is connected to the high voltage side of the power source S is interposed between the bottom of the plates 30 and the bottom 22 of the U-shaped housing G1. Hence, the high voltage bus 26 operates as a high voltage shield with respect to the largest area of the electrodes P1 that could be capacitively coupled to ground. It is only the very edges of the plates 30 that can "see" the side walls 20 and 21 of the housing G1 (along with points 28 of the electrodes P1, the latter being necessary to provide ion emission therebetween). Since the upper surfaces of the plates 30 are oriented obliquely to the side walls 20 and 21, they contribute along with the side edge capacitance of the plates and the points per se minimum capacitive coupling with respect to the grounded housing G1.

Figure 5A:
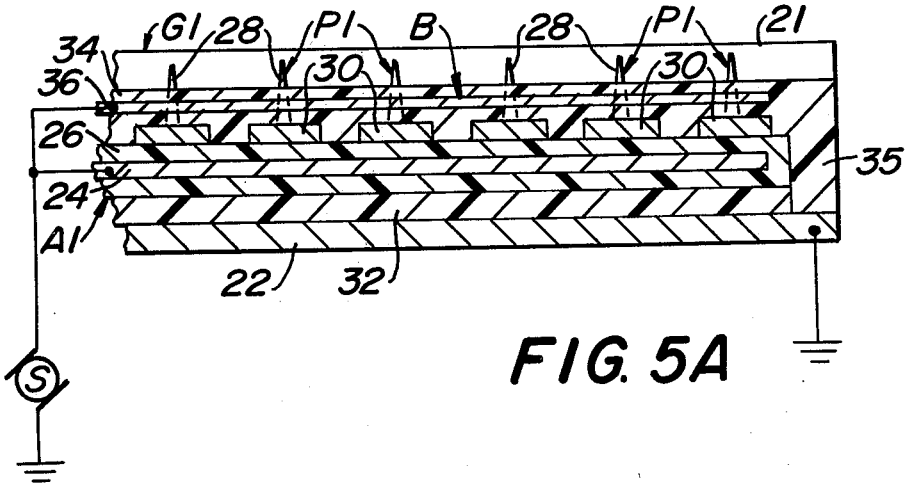
FIG. 5A is a sectional view taken along lines 5A—5A of FIG. 4A.

While the design of FIGS. 4 and 5 reduce the electrode-to-ground capacitance $C_g$ appreciably by using the high voltage bus 24 itself as both the shield as well as the means for coupling the electrodes P1 capacitatively, thereby affording an inexpensive mode for reducing electrode-to-ground capacitance. In FIGS. 4A and 5A there is shown a means for further reducing such capacitance $C_g$. In this latter modification, a pair of conductive ribbons, rods or bars 36 and 38 extend longitudinally through the yoke 34 above the plates 30 on each side of the needles 28. When the high voltage power supply S is connected to the members 36 and 38 as well as the bus 24 of cable A1, these members 36 and 38 define a high voltage shield B intermediate the upper surface of the plates 30 and the adjacent ground of the sides 20 and 21 of the housing G1 obliquely oriented thereto. The conductive shield B thus further diminishes the capacitance between the said plates and ground by additionally reducing the plate area that can be "seen" by ground. That is, by shielding a major portion of the plates 30 by way of the high voltage interface B and the high voltage bus 24, the capacitance of said plates 30 with respect to ground is further diminished thereby providing an attendant increase in the proportion of supply voltage $V_S$ that can be applied to the points P1 per se. Since only the lateral edges of the plates 30 "look" at ground, such edge faces merely provide an inconsequential coupling as compared to the total surface area of said plates.

Figure 6:
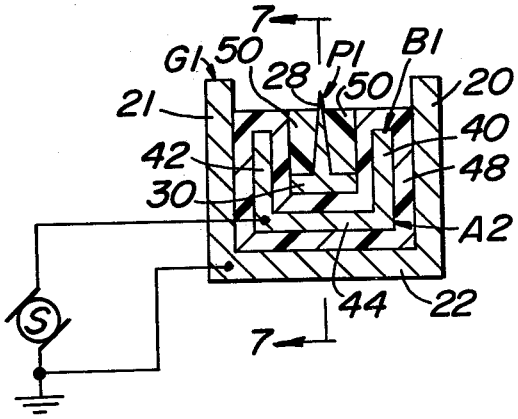
FIG. 6 is a sectional view of another embodiment of a shockless static eliminator according to the present invention.
Figure 7:
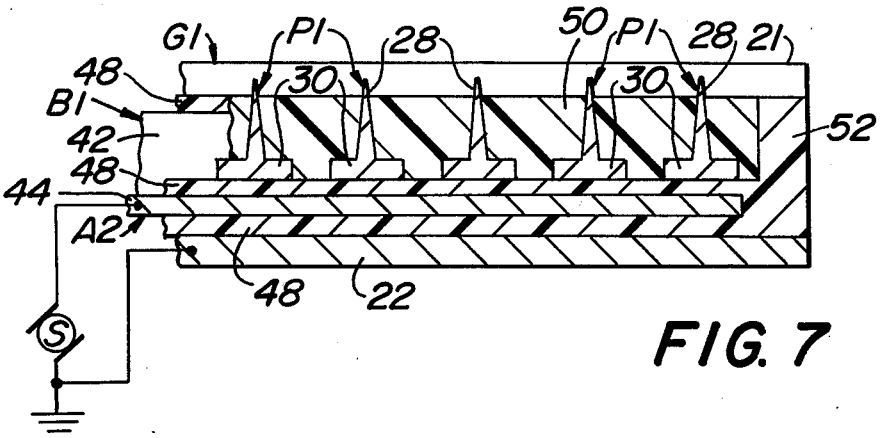
FIG. 7 is a sectional view taken along lines 7—7 of FIG. 6.

Referring now to FIGS. 6 and 7, the discharge electrodes P1, again employing needle points 28 perpendicularly affixed to rectangular conductive plates 30, are capacitively coupled to a high voltage cable A2. The cable A2 in this case is channel- or U-shaped in cross section and includes a pair of side walls 40 and 42 integrally projecting from a substantially flat medial bus 44. The high voltage side of the power supply S is directly connected to the bus 44 and accordingly to the side walls 40 and 42. The U-shaped conductor is entirely encapsulated in an insulative sheath 48 in a conventional manner. The housing G1 is connected to the low voltage side of power supply S by way of ground, again in accordance with customary practice. An insulative spine 50 with longitudinally spaced apertures interfitting over the points 28 retains the discharge electrodes within the channel of the U-shaped cable A2 while the entire assembly is fixed within the housing G1 by end caps 52.

As may be observed, the plates 30 are capacitively coupled to the medial bus 44 whereby the high voltage A.C. causes a dual polarity emission to be effected at the points 28. Simultaneously, these plates 30 are additionally shielded from the walls 20 and 21 of housing G1 by way of the interfacing side busses 40 and 42 which also carry the A.C. high voltage. Note that in the U-shaped shield embodiment shown in FIGS. 6 and 7, all surfaces of plates 30, both edge and planar faces, are concealed from ground by the high voltage side walls so as to minimize the capacitive coupling $C_g$ with respect to ground. Only the tips of points 28 are exposed to ground thereby promoting maximum ion production therebetween.

Figure 8:
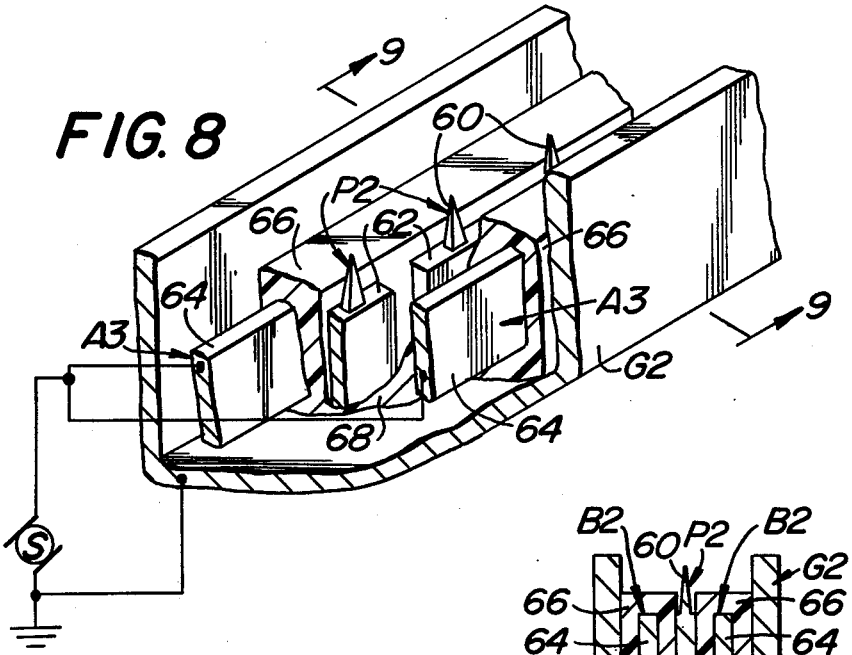
FIG. 8 is a perspective view, and partly broken away, of still another embodiment of a shockless static eliminator according to the present invention.
Figure 9:
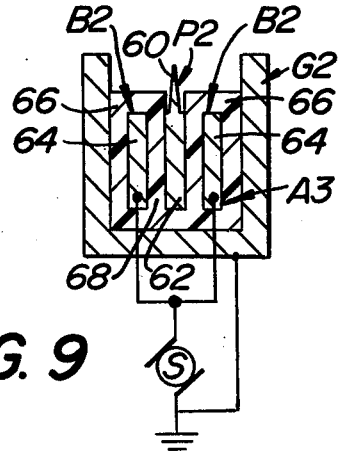
FIG. 9 is a sectional view taken generally along lines 9—9 of FIG. 8.

Referring now to FIGS. 8 and 9, there is shown a sandwich construction in which a plurality of longitudinally spaced discharge electrodes P2 are encapsulated between a pair of flat cables A3. Each discharge electrode P2 comprises a spike 60 that is generally coplanar with a flat plate portion 62. The spike 60 and plate portion 62 may be integrally formed as shown in prior U.S. Pat. No. 3,652,897 or No. 3,769,695. The central conductors 64 of each of the cables A3 are directly connected to the high voltage side of the power supply S. The sandwich construction may either employ a laminated or molded system as shown and described in the above patents or individual cables, such as cables A1, wherein an insulating sheath 66 covers each conductor 64. A flattened channel G2 may be used to encase the laminar interior construction, in which situation the zones below the bottom edges of the plates 62 are sealed with a bead 68 of a suitable resin, such as an epoxy. As is readily apparent, each of the conductors 64 of the flat cables A3 not only act as one plate of a capacitor with respect to the plate portions 62 of the discharge electrodes P2, the sheaths 66 forming the dielectric therebetween, but in addition, each of the conductors 64 also act as a high voltage shield B between the said plate portions 62 and ground G2. In the embodiment of FIGS. 8 and 9, only the very bottom edges of the plates 62 are exposed to ground through the epoxy bead 68. Other variations (not shown) can utilize strips of conductive materials on each side of the cables A3 without incorporating the medial portion of the channel housing G2 or exclude such a channel entirely and rely on the machinery ground.

Figure 10:
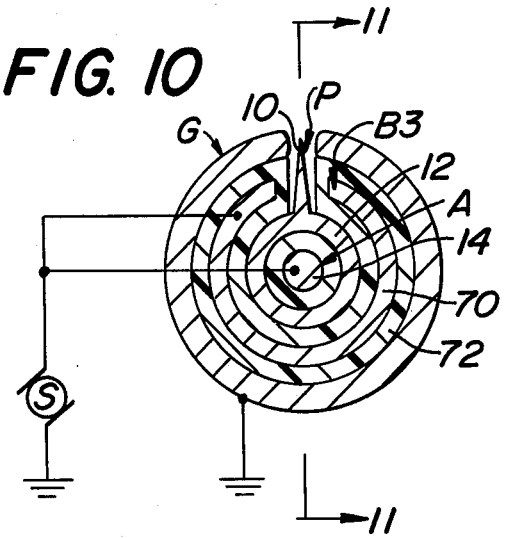
FIG. 10 is a sectional view of yet a further embodiment of a shockless static eliminator according to the instant invention.
Figure 11:
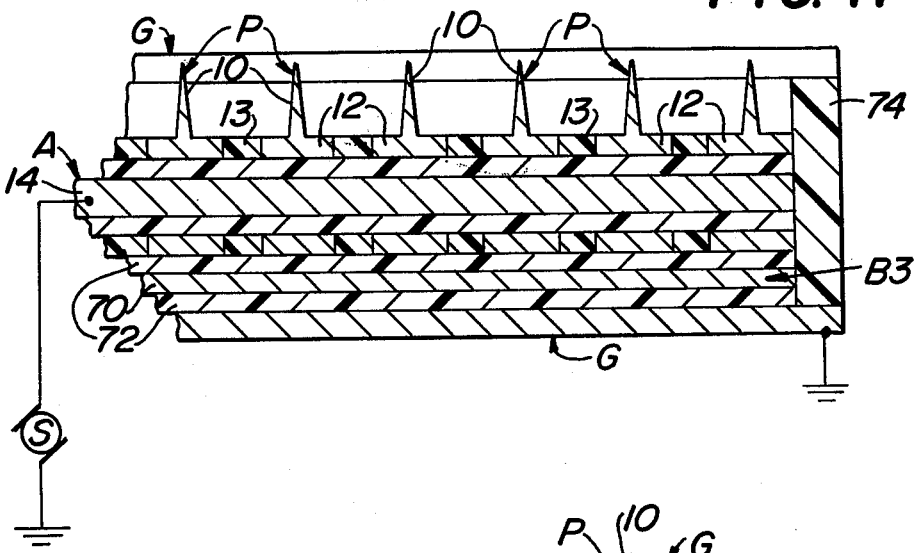
FIG. 11 is a sectional view taken generally along lines 11—11 of FIG. 10.

Referring now to FIGS. 10 and 11, there is shown a modification of the co-axial ring capacitive coupling defined by the conventional system illustrated by FIG. 1 wherein a plurality of conductive rings 12 longitudinally spaced from each other by insulative tubes 13 are concentrically disposed about a standard high voltage cable A whose central conductor 14 insulated by sheath 16 threads through the rings and tubes and is connected to the high voltage power source S. A flexible high voltage bus B3 comprising a conductive inner core 70 and insulated by sheath 72 fills the gap between the tubular conductive housing G and the periphery of the rings 12. When the hot side of the power source S is connected to the bus 70 as well as to the central conductor 14, the bus forms a high voltage shield or interface between the conductive rings 12 and the grounded housing G so as to reduce the $C_g$ capacitance between the electrodes P and ground thereby increasing the proportion of the voltage applied to the points 10. Note that the normal capacitance between the high voltage conductor 14 and the ring portions 12 still exists, i.e. $C_p$. However, not only does the curved insulated bus shield the conductive ring portions 12 from the grounded housing G, thus keeping the voltage on the points high, but in addition, the bus B3 also increases the capacitive coupling between the high voltage and said ring portions 12 thereby adding to the capacitance between conductor 14 and the rings.

Figure 12:
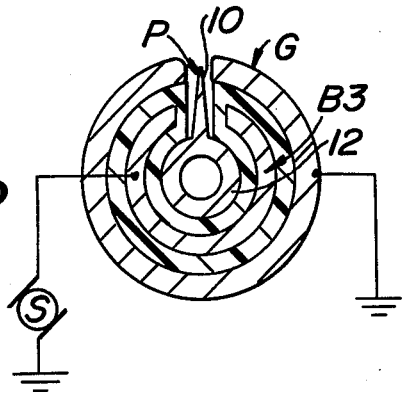
FIG. 12 is a sectional view of yet still another embodiment of the present invention.

Still another embodiment of the present invention is illustrated in FIG. 12 wherein the central cable A has been removed from its co-axial disposition within the rings 12 and insulated sleeves 13 and only the curved high voltage bus B3 whose inner core 70 is connected to the high voltage power supply S. In this embodiment, the curved bus B3 acts both as a capacitive coupling to the ring portions 12 from the outside to the inside by way of core 70 to rings 12 but also defines a shield to reduce the electrode-to-ground capacitance $C_g$. In this latter embodiment, it is also apparent that short lengths of rods may be substituted for the rings, the circumference of the rods (or the rings) defining the capacitor plate.

In summary, the high voltage shield B for the capacitively coupled discharge electrodes P reduces the capacitance $C_g$ between the condenser plates of said electrodes and ground without altering the essential capacitance $C_p$ between such electrodes and the high voltage. As a consequence, a materially smaller high voltage power supply S can be employed for applying the voltage $V_p$ to the points, thereby reducing insulation and component requirements for both the power pack S as well as the static bar itself including all connections therebetween.

Although this invention has been described in considerable detail, such description is intended as being illustrative rather than limiting, since the invention may be variously embodied, and the scope of the invention is to be determined as claimed.

What is claimed is:

1. In a static neutralizer having at least one discharge electrode adjacently spaced from a conductive member connected to the ground side of an A.C. high voltage power source and first means capacitively coupling each discharge electrode to the high voltage side of said A.C. power source, the improvement comprising a conductive shield spaced intermediate said grounded conductive member and said first means, and means connecting said conductive shield to the high voltage side of the A.C. power source in order to minimize the capacitive coupling between said first means and said conductive member, the improvement being further characterin that said first means is of flat plate configuration, and said discharge electrode constitutes a point outwardly projecting therefrom.

2. The static neutralizer of claim 1 wherein said first means includes a plurality of longitudinally spaced conductive plate members each having a conductive needle projecting perpendicular to a first surface thereof.

3. The static neutralizer of claim 2 wherein said conductive plate members are of flat disposition and a flat high voltage bus in adjacently spaced insulated disposition with respect to the other side of said flat conductive plate members.

4. The static neutralizer of claim 3 including a pair of longitudinally extending ribbons adjacently spaced in insulative disposition from the first surface of said conductive plate members, and connected to the high voltage side of said A.C. power source.

5. The static neutralizer of claim 4 wherein said grounded conductive member comprises a U-shaped housing about said discharge electrodes.

6. The static neutralizer of claim 2 wherein said high voltage bus is of U-shaped configuration and having side walls spaced about the lateral edges of said conductive plate members.

7. The static neutralizer of claim 1 wherein said first means includes a plurality of longitudinally spaced flat plates, each having a conductive needle extending therefrom in coplanar disposition therewith.

8. The static neutralizer of claim 7 wherein a flat high voltage bus is in adjacently spaced disposition from each of the opposed surfaces of said flat plates.

9. the static neutralizer of claim 8 wherein said conductive member comprises a longitudinally extending conductive strip spaced outboard of said high voltage busses.

10. The static neutralizer of claim 9 wherein said conductive strips include a medial portion to define a U-shaped housing.

11. In a static neutralizer having at least one discharge electrode capacitively coupled to the high voltage side of an A.C. high voltage power source and an electrode enclosing conductive housing connected to the ground side of the A.C. power source while substantially encircling each capacitively coupled conductive member from which the discharge electrodes extend, the improvement comprising a conductive shield spaced intermediate each capacitively coupled conductive member and the encircling conductive housing which forms the enclosing ground for the discharge electrodes, and means connecting said conductive shield to the high voltage side of the A.C. power source whereby said shield defines an electric screen that minimizes the otherwise substantial capacitive coupling between the housing and the conductive members supporting the partially enclosed discharge electrodes.

12. The static neutralizer of claim 11 wherein each of the capacitively coupled conductive members of the discharge electrodes is tubular in configuration.

13. The static neutralizer of claim 12 wherein said conductive shield is arcuate in configuration.

14. The static neutralizer of claim 13 wherein said conductive shield is substantially concentric with said conductive housing and each of said tubular conductive members.

15. The static neutralizer of claim 13 including an insulated high voltage bus coaxial with the tubular conductive members.

* * * * *